US008807372B2

(12) United States Patent
Kao

(10) Patent No.: US 8,807,372 B2
(45) Date of Patent: Aug. 19, 2014

(54) CAP CONTAINER

(71) Applicant: Chih-Hung Kao, New Taipei (TW)

(72) Inventor: Chih-Hung Kao, New Taipei (TW)

(73) Assignee: Highplus International Co., Ltd., New Taipei (TW)

( * ) Notice: Subject to any disclaimer, the term of this patent is extended or adjusted under 35 U.S.C. 154(b) by 0 days.

(21) Appl. No.: 14/021,244

(22) Filed: Sep. 9, 2013

(65) Prior Publication Data

US 2014/0175097 A1 Jun. 26, 2014

Related U.S. Application Data

(63) Continuation of application No. 13/727,491, filed on Dec. 26, 2012, now abandoned.

(51) Int. Cl.
*A47G 19/22* (2006.01)
*B65D 21/02* (2006.01)

(52) U.S. Cl.
USPC ..... 220/287; 220/521; 220/523; 220/22.83; 220/709; 220/574; 215/319; 215/388

(58) Field of Classification Search
CPC ..... B65D 2543/00046; B65D 2543/00092; B65D 2543/0022; B65D 2543/00462; B65D 2543/00768; B65D 2251/08; B65D 41/18
USPC ..... 220/212, 287, 521, 523, 716, 717, 705, 220/709, 23.83, 23.86, 574; 215/228, 329, 215/387–389, 319
See application file for complete search history.

(56) References Cited

U.S. PATENT DOCUMENTS

| | | | | |
|---|---|---|---|---|
| 5,180,079 | A * | 1/1993 | Jeng | 220/705 |
| 6,338,417 | B1 * | 1/2002 | Ferraro | 220/23.83 |
| 7,217,434 | B1 * | 5/2007 | Loh et al. | 426/115 |

* cited by examiner

*Primary Examiner* — Fenn Mathew
*Assistant Examiner* — James N Smalley
(74) *Attorney, Agent, or Firm* — Tracy M. Heims; Apex Juris, pllc

(57) ABSTRACT

A cap container includes a tank, a conical protrusion, and a stepped coupling. The tank includes an upper rim, a bottom opposite to the upper rim, and a hole formed through the bottom. The conical protrusion includes a lower end, an upper end, an inner wall extending from the lower end to the upper end and defining a channel, and an engagement part formed at the inner wall near the lower end. The channel passes through the lower end and the upper end and communicates with the hole of the tank, and the channel can receive a straw. The stepped coupling has at least one annular groove and is formed at the bottom of the tank. The cap container can be filled with solid food and combined with a top a commercially available drink container such as a bottle or a cup filled with liquid by the engagement part of the conical protrusion. A user can hold the bottle or the cup combined with the cap container by a hand, and the other hand can swing freely or take the solid food in the tank, such that the user can also suck the liquid from the bottle or cup by the straw at the same time.

11 Claims, 10 Drawing Sheets

CAP CONTAINER

RELATED PATENT APPLICATION

This application is a continuation-in-part application and claims priority from subject matter disclosed in the earlier filed patent application Ser. No. 13/727,491, filed on Dec. 26, 2012, which is incorporated herein in its entirety by reference.

BACKGROUND OF THE INVENTION

1. Field of the Invention

The present inventions relates to a cap container, and more particularly to a cap container having a tank and a conical protrusion connecting to the tank, such that the cap container can be combined with the top of a bottle by an engagement part of the conical protrusion.

2. Description of the Prior Art(s)

With reference to FIG. 10, when a consumer buys both solid food and drink, it is inconvenient to hold a container filled with solid food by one hand and hold the drink by the other hand. The most common scenario, for example, is that when going to the movies, mostly, consumers would buy a drink and popcorns at the same time. When the consumers are about to enter the movie theater, they have no free hand to show the movie tickets to the theater personnel. Moreover, when consumers want to eat the popcorns while drinking, they have to put down the drink on the ground or the handrail in order to hold the pack of popcorns. Such exchanging process is also very inconvenient.

SUMMARY OF THE INVENTION

To overcome the above-mentioned shortcomings, the present invention provides a cap container to overcome the aforementioned inconvenience.

To achieve the objective, the cap container in accordance with the present invention includes a tank, a conical protrusion, an engagement part, and a stepped coupling.

The tank includes an upper rim, a bottom opposite to the upper rim, and a hole formed through the bottom. The tank can contain solid foods such as popcorns, marshmallows, shrimp chips, cakes, candies or puffs.

The conical protrusion is hollow and includes a lower end, an upper end, an inner wall extending from the lower end to the upper end and defining a channel, wherein the channel passes through the lower end and the upper end and communicates with the hole of the tank, and an engagement part formed at the inner wall near the lower end. The lower end connects to the bottom of the tank. The channel communicates with the hole of the tank, the channel can receive a straw, and the straw can enter into a drink container such as a bottle for a user can to suck liquid from the bottle by the straw. The engagement part detachably abuts a top of the drink container to close the drink container.

The stepped coupling has at least one annular groove and is formed between the bottom of the tank and the lower end of the conical protrusion. A concavity of the at least one annular groove of the stepped coupling faces away from the tank, and the shape of the concavity of the stepped coupling corresponds to the top of a commercially available drink container such as an easy open can or a drink cup.

Preferably, an inner diameter of the channel decreases progressively from the lower end to the upper end of the conical protrusion.

Preferably, a height of the conical protrusion from the lower end to the upper end is equal to a height of the tank from the bottom to the upper rim.

Preferably, an outer diameter of the tank increases progressively from the bottom to the upper rim.

Preferably, the stepped coupling includes a first annular groove and a second annular groove, wherein a circumference of the second annular groove is larger than a circumference of the first annular groove, and the second annular groove surrounds the first annular groove concentrically. The first annular groove and the second annular groove respectively correspond in shape to a top of a commercially available drink container, such that the present invention can be detachably combined with the top of the container. For example, the first annular groove corresponds in shape to a top of commercially available container such as an easy open can, and the second annular groove corresponds in shape to a top of another commercially available container such as a drink cup.

Preferably, at least two projections are formed diametrically opposite each other on the engagement part and extending toward each other and toward the inner wall of the conical protrusion. The at least two projections of the engagement part abut detachably a top of a commercially available drink container such as a PET bottle, such that the present invention can be detachably combined with the top of the corresponding drink container.

Preferably, the cap container further includes a membrane covering the upper rim of the tank to form an enclosed space.

More preferably, the membrane also covers the upper end to seal the channel of the conical protrusion.

More preferably, the membrane further includes an extrusion connecting to the membrane. The extrusion protrudes from the upper rim of the tank, such that the extrusion can be easily torn off from the upper rim of the tank.

More preferably, the membrane is made of aluminum foil or plastic.

More preferably, the membrane is made of polyethylene or polypropylene.

Preferably, the cap container includes a trough connecting to a wall of the tank and located between the upper rim and the bottom of the tank.

More preferably, the trough further has an opening facing to the upper rim of the tank.

When the cap container in accordance with the present invention is in use, a user can put solid food into the tank, and then the membrane can be covered upon the upper rim of the tank to enclose the solid food in the tank. The user can combine the cap container filled with solid food with the top of the corresponding commercially available drink container filled with liquid by the at least two projections of the engagement part of the conical protrusion or the stepped coupling. Then the straw can be inserted from the membrane covering the upper rim of the tank through the channel and the lower end of the conical protrusion to the corresponding bottle. The user can hold the corresponding bottle combined with the cap container by a hand, and the other hand can swing freely or take the solid food in the tank, such that the user can also suck the liquid from the bottle by the straw at the same time.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
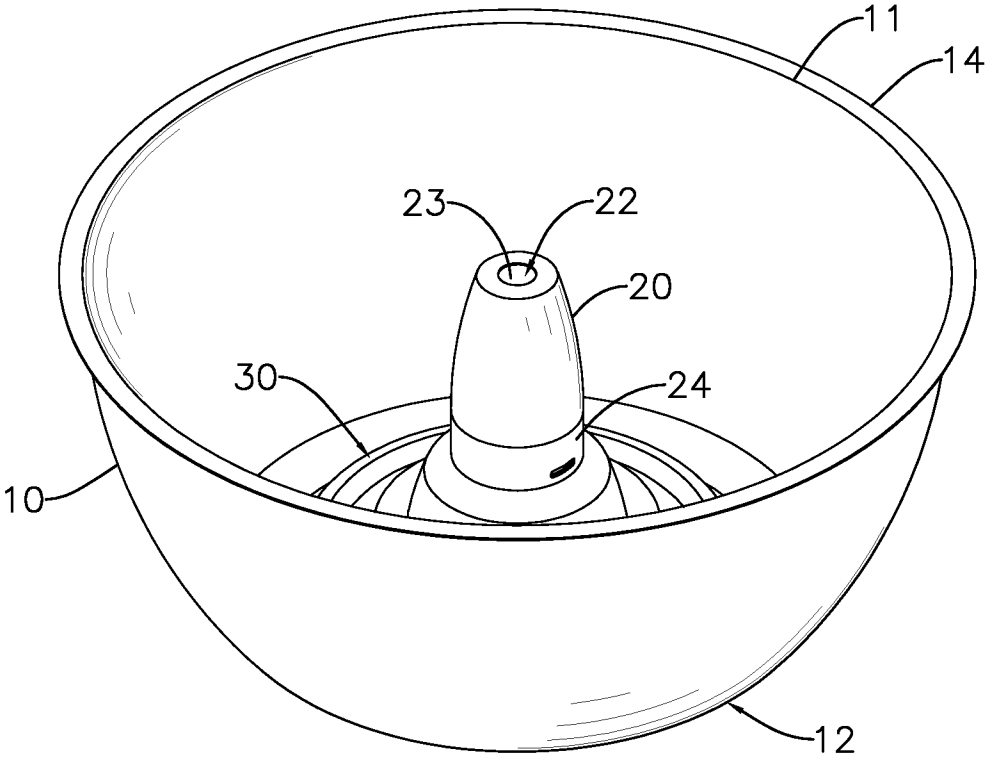
FIG. 1 is a perspective view of a cap container in accordance with the present invention.
Figure 2:
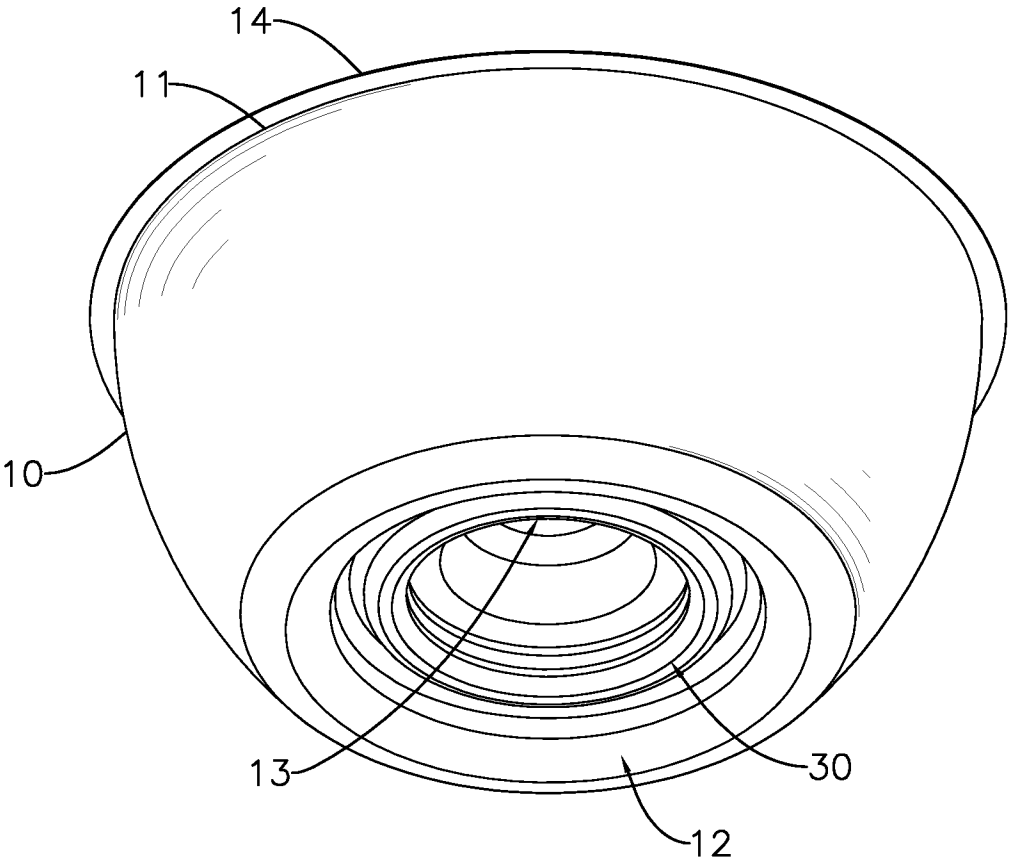
FIG. 2 is a bottom view of the cap container in FIG. 1.

With reference to FIGS. 1 to 2, a first embodiment of a cap container in accordance with the present invention has a tank 10 and a conical protrusion 20, and a stepped coupling 30.

The tank 10 includes an upper rim 11, a bottom 12 opposite to the upper rim 11, a hole 13 through the bottom 12, and an extension section 14 horizontally extending from the upper rim 11. Wherein the outer diameter of the tank 10 increases progressively from the bottom 12 to the upper rim 11, and the tank 10 is bowl-shaped. The tank 10 can contain solid foods such as popcorns, marshmallows, shrimp chips, cakes, candies or puffs.

Figure 3:
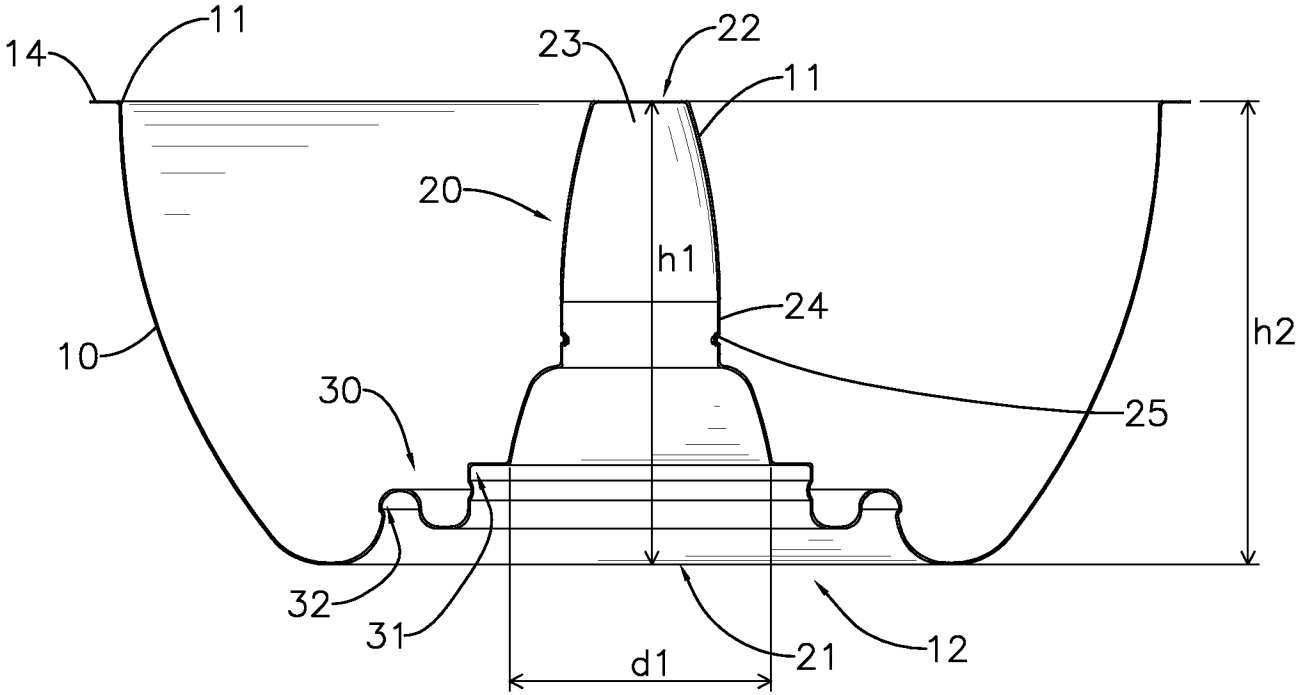
FIG. 3 is a cross-sectional view of the second embodiment of the cap container in FIG. 1.
Figure 4:
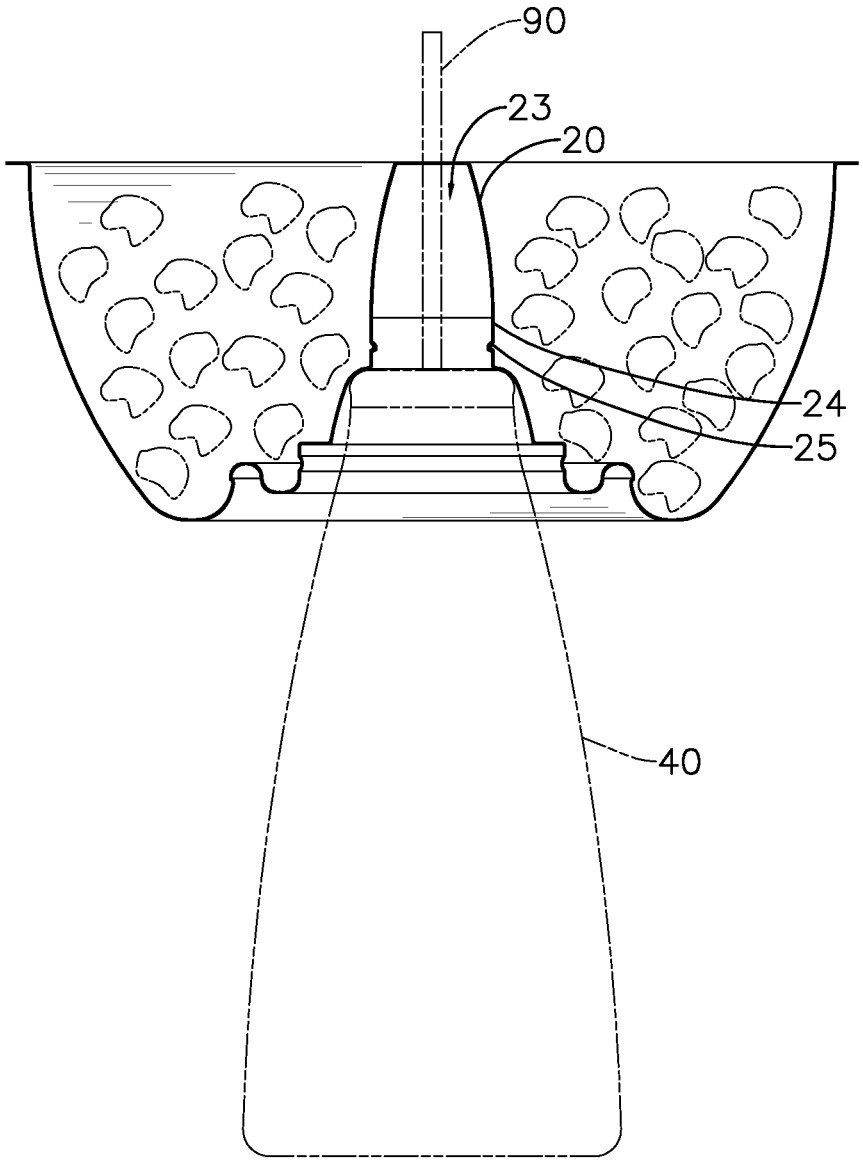
FIG. 4 is a cross-sectional and operational side view of the cap container in accordance with the present invention for combining with a bottle.
Figure 5:
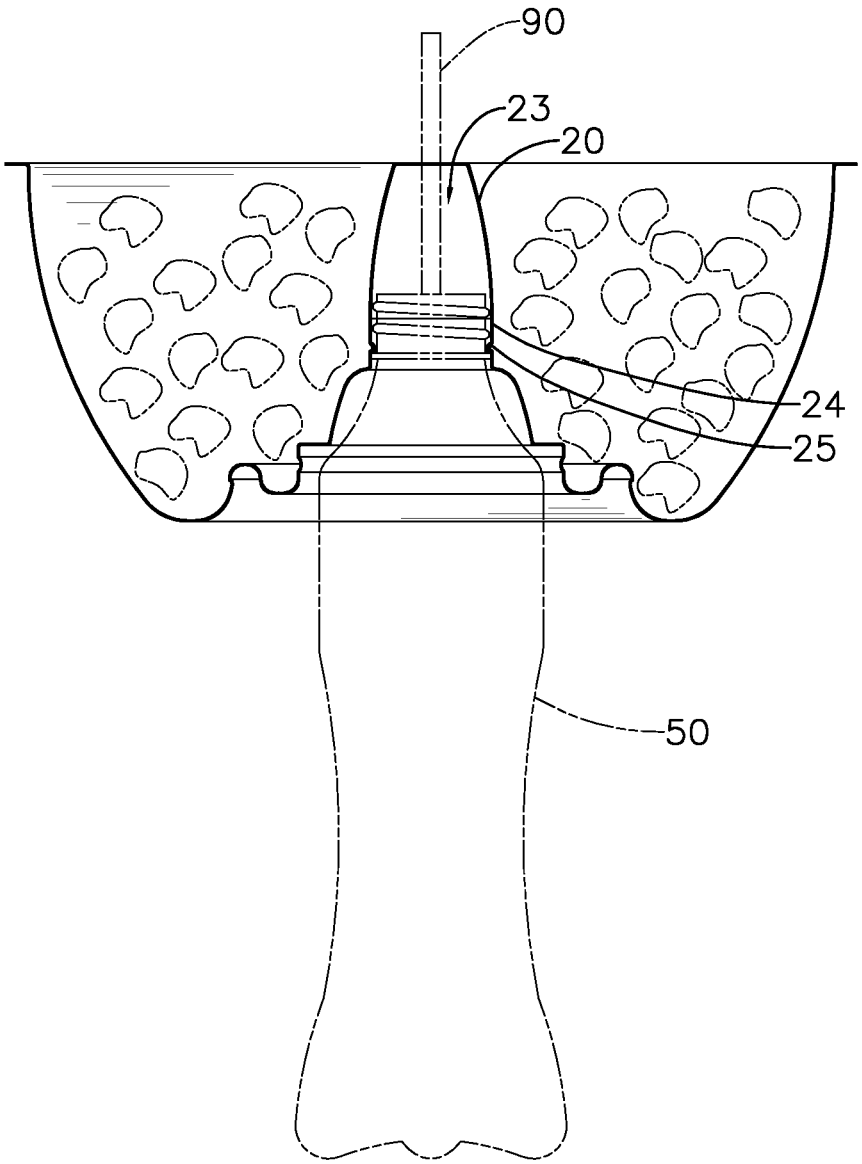
FIG. 5 is a cross-sectional and operational side view of the cap container in accordance with the present invention for combining with the bottle having a top thread.

With reference to FIG. 3, the conical protrusion 20 is hollow and includes a lower end 21 connected to the bottom 12 of the tank 10, an upper end 22, an inner wall extending from the lower end 21 to the upper end 22 and defining a channel 23, wherein the channel 23 passes through the lower end 21 and the upper end 22 and communicates with the hole 13 of the tank 10, and an engagement part 24 is formed at the inner wall near the lower end 21. The height h1 of the conical protrusion 20 from the lower end 21 to the upper end 22 is equal to the height h2 of the tank 10 from the bottom 12 to the upper rim 11. The inner diameter d1 of the channel decreases progressively from the lower end 21 to the upper end 22 of the conical protrusion 20. At least two projections 25 are formed diametrically opposite each other on the engagement part 24 and extend toward each other and toward the inner wall of the conical protrusion 20. With reference to FIGS. 4 and 5, the at least two projections 25 abut detachably a top of a commercially available container such as a bottle 40 or a PET bottle 50 having a thread on the top, such that the engagement part 24 of the conical protrusion 20 is detachably combined with the top of the bottle by pressing or buckling. The channel 23 can receive a straw 90.

With reference to FIG. 3, the stepped coupling 30 has at least one annular groove formed between the bottom 12 of the tank 10 and the lower end 21 of the conical protrusion 20. A concavity of the at least one annular groove of the stepped coupling faces away from the tank 10, and the shape of the concavity of the stepped coupling 30 corresponds to the top of a commercially available container such as an easy open can or a drink cup.

Figure 6:
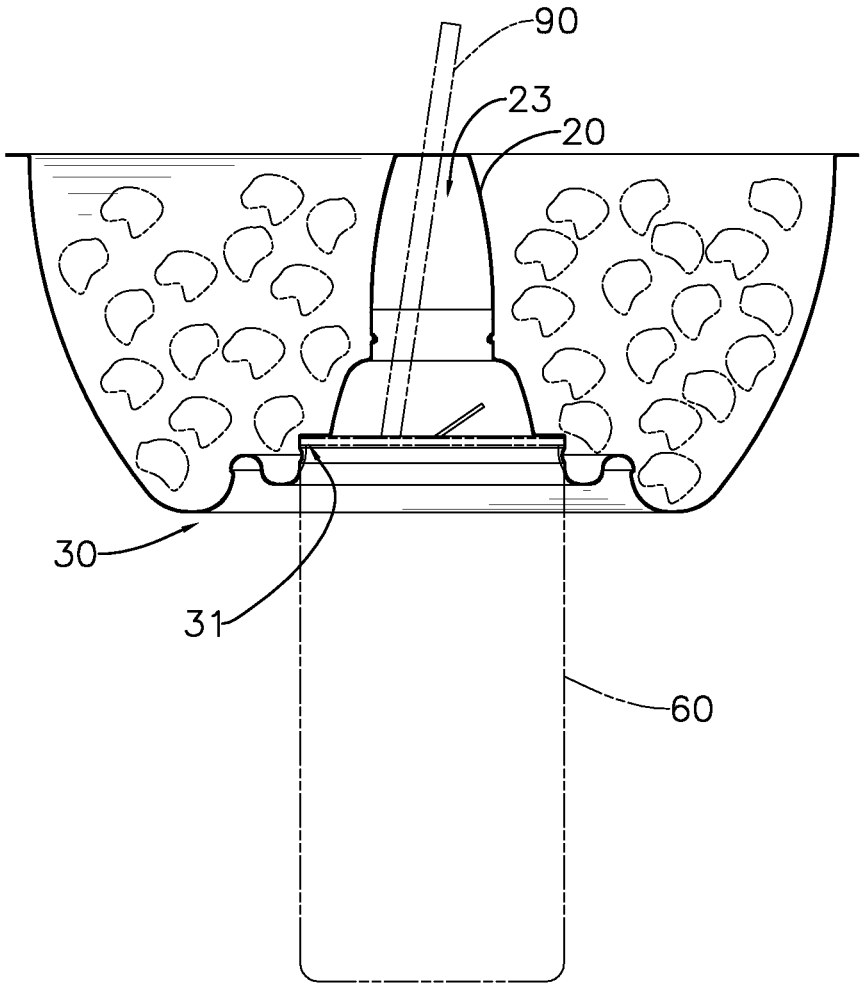
FIG. 6 is a cross-sectional and operational side view of the cap container in accordance with the present invention for combining with an easy open can.
Figure 7:
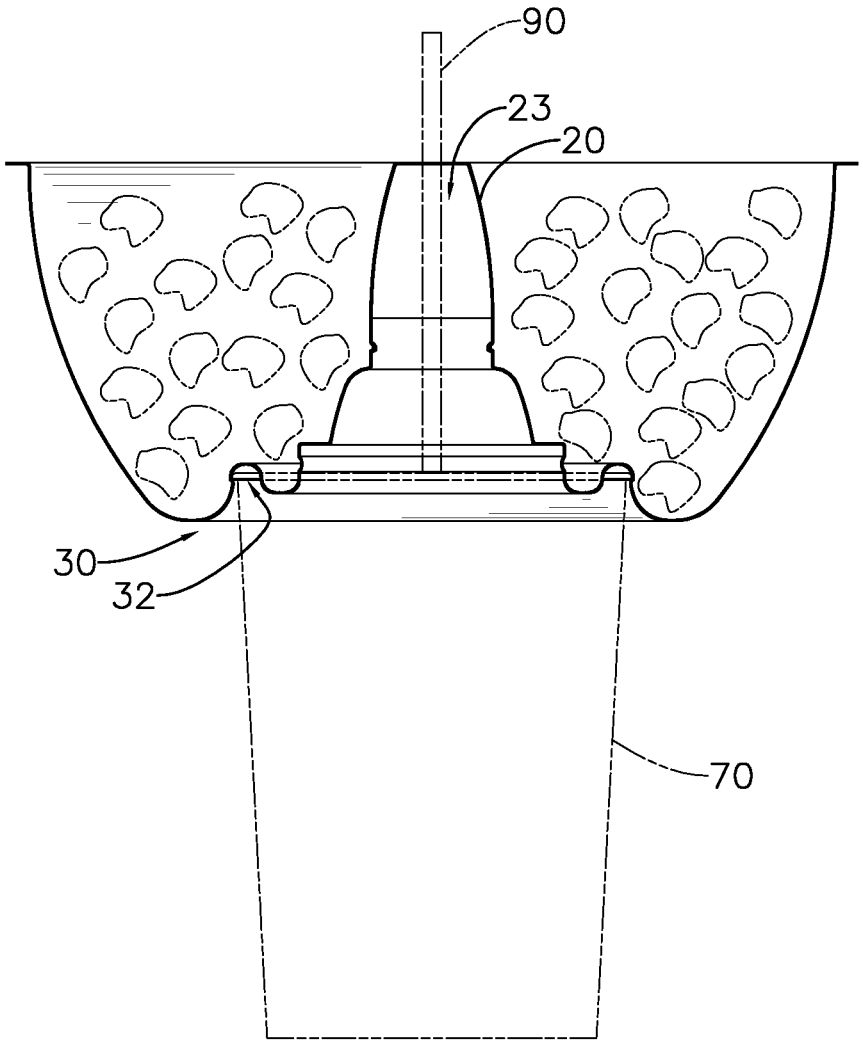
FIG. 7 is a cross-sectional and operational side view of the cap container in accordance with the present invention for combining with a drink cup.

In a second embodiment of the present invention, with reference to FIG. 3, the stepped coupling 30 of the cap container further includes a first annular groove 31 and a second annular groove 32, a circumference of the second annular groove 32 is larger than a circumference of the first annular groove 31, wherein the second annular groove 32 surrounds the first annular groove 31 concentrically. The first annular groove 31 and the second annular groove 32 respectively correspond in shape to a top of a commercially available drink container, such that the present invention can be detachably combined with the top of the corresponding container. With reference to FIG. 6, the first annular groove 31 of the stepped coupling 30 corresponds in shape to a top of a commercially available container such as an easy open can 60. With reference to FIG. 7, the second annular groove 32 of the stepped coupling 30 corresponds to a top of a commercially available container such as a drink cup 70.

Figure 8:
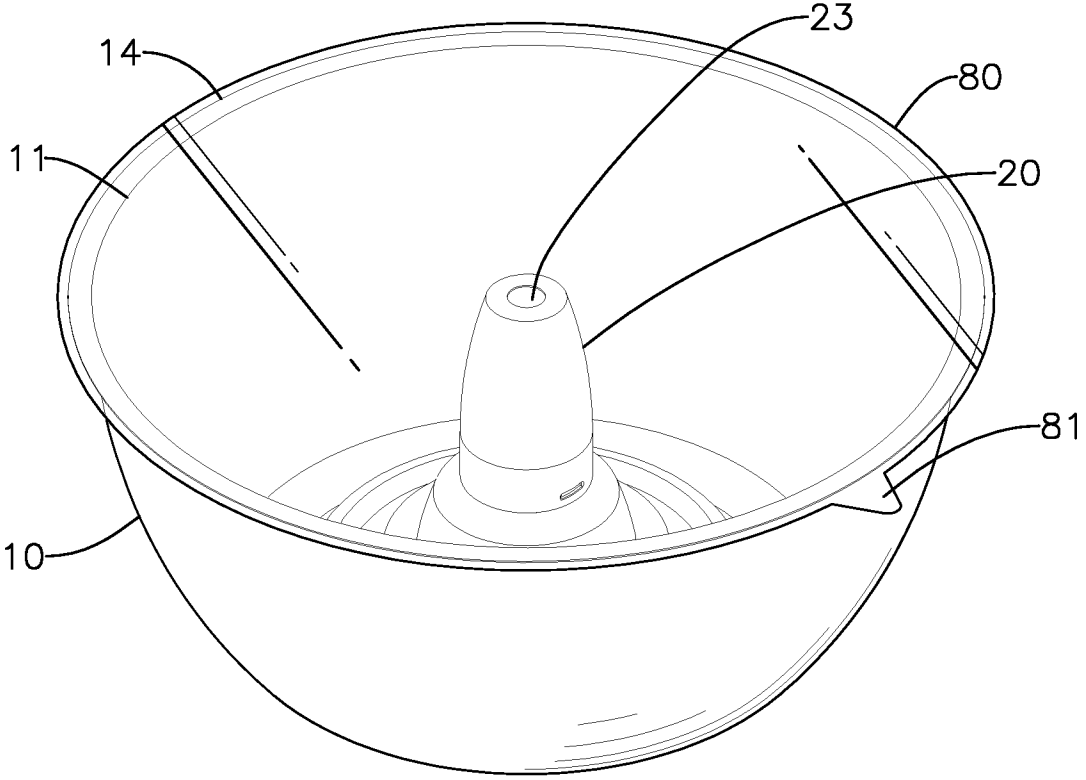
FIG. 8 is a perspective view of a third embodiment of the cap container in accordance with the present invention showing a membrane covered on the upper rim and the extension section of the tank.

In a third embodiment of the present invention, with reference to FIG. 8, the cap container further includes a membrane 80 covering the upper rim 11 and the extension section 14 of the tank 10 to form an enclosed space. The membrane 80 also covers the upper end 21 to seal the channel 23 of the conical protrusion 20. The membrane 80 further includes an extrusion 81 connecting to the fringe of the membrane 80. The extrusion 81 protrudes from the extension section 14 of the tank 10, such that the extrusion 81 can be torn off easily from the upper rim 11 of the tank 10. The material of the membrane 80 is aluminum foil or plastic such as polyethylene or polypropylene.

Figure 9:
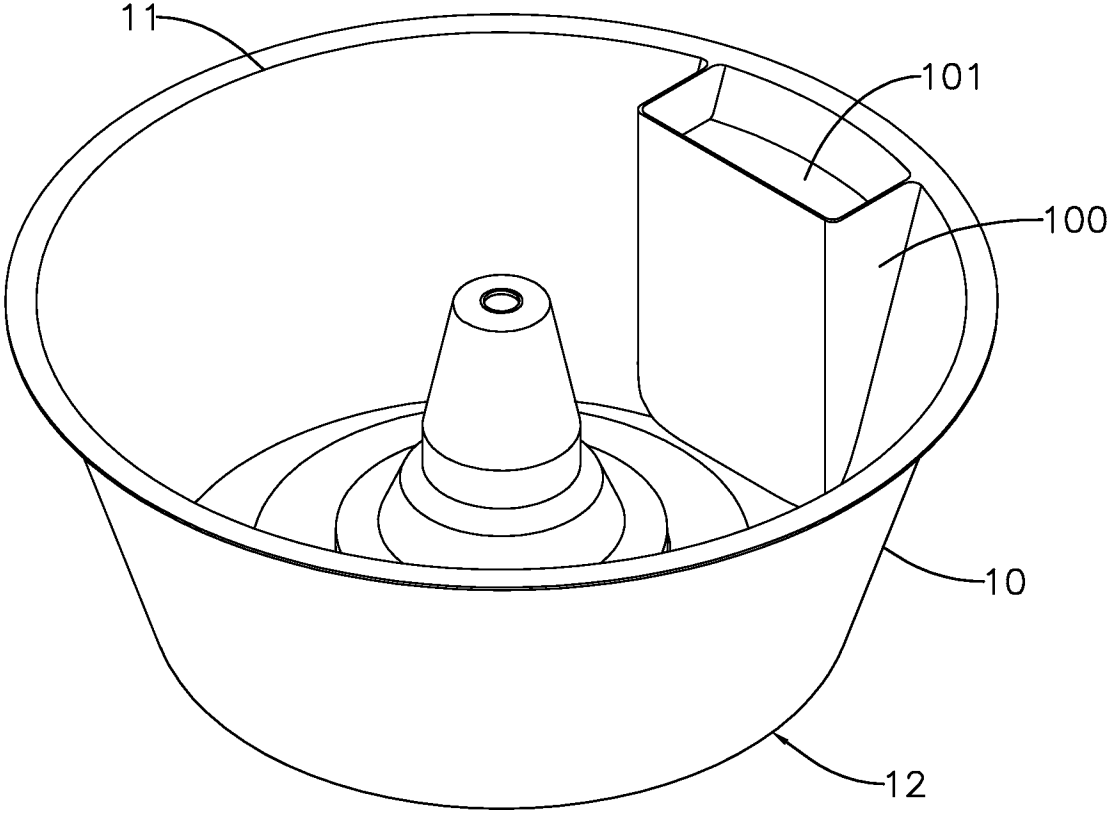
FIG. 9 is a perspective view of a fourth embodiment of the cap container in accordance with the present invention.
Figure 10:
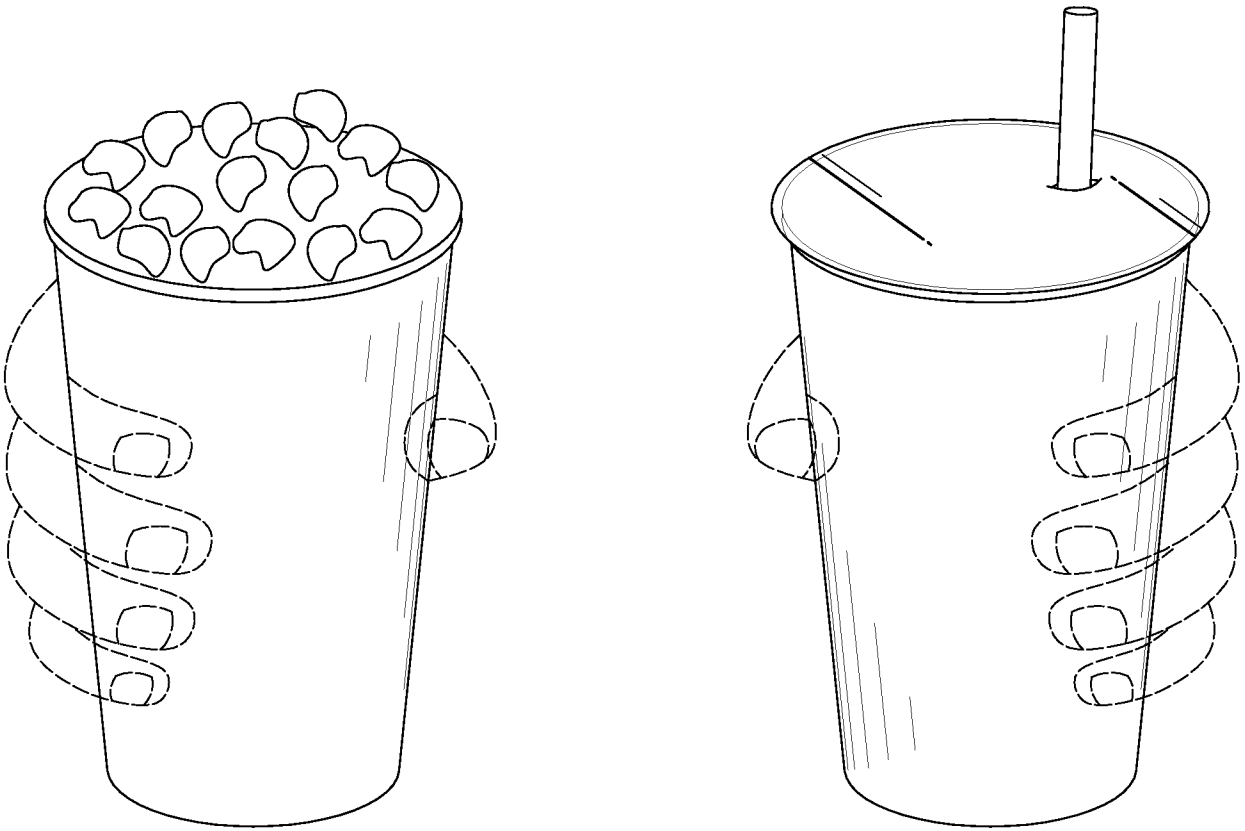
FIG. 10 PRIOR ART
FIG. 10 is an operational side view of containers of the prior art.

In a fourth embodiment of the present invention, with reference to FIG. 9, the cap container further includes a trough 100 connecting to a wall of the tank 10 and located between the upper rim 11 and the bottom 12 of the tank 10. The trough 100 further includes an opening 101 facing to the upper rim 11 of the tank 10. The trough 100 can be filled with a sauce such as potato sauce or pickled cucumber sauce, whereupon, the consumers can hold the cap container by one hand, and can grab potato chips or fries to dip said sauce in the trough 100 by the other hand.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cap container comprising:

a tank having:

an upper rim;

a bottom opposite to the upper rim; and, a hole formed through the bottom;

a conical protrusion having:

a lower end connected to the bottom of the tank, an upper end opposite to the lower end;

an inner wall extending from the lower end to the upper end and defining a channel, wherein the channel passes through the lower end and the upper end and communicates with the hole of the tank;

an engagement part formed at the inner wall near the lower end, wherein at least two projections are formed diametrically opposite each other on the engagement part and extend toward each other and toward the inner wall;

a stepped coupling having at least one annular groove and formed between the bottom of the tank and the lower end of the conical protrusion, wherein a concavity of the at least one annular groove of the stepped coupling faces away from the tank; and, a trough connecting to a wall of the tank and located between the upper rim and the bottom of the tank, wherein the trough further has an opening facing to the upper rim of the tank.

2. The cap container as claimed in claim 1, wherein an inner diameter of the channel decreases progressively from the lower end to the upper end of the conical protrusion.

3. The cap container as claimed in claim 1, wherein a height of the conical protrusion from the lower end to the upper end is equal to a height of the tank from the bottom to the upper rim.

4. The cap container as claimed in claim 1, wherein an outer diameter of the tank increases progressively from the bottom to the upper rim.

5. The cap container as claimed in claim 1, wherein the stepped coupling includes a first annular groove and a second annular groove, a circumference of the second annular groove is larger than a circumference of the first annular groove, wherein the second annular groove surrounds the first annular groove concentrically.

6. The cap container as claimed in claim 1, wherein the cap container includes an extension section extending horizontally from the upper rim.

7. The cap container as claimed in claim 6, wherein the cap container includes a membrane covering the upper rim and the extension section of the tank to form an enclosed space.

8. The cap container as claimed in claim 1, wherein the cap container includes a membrane covering the upper rim of the tank to form an enclosed space.

9. The cap container as claimed in claim 6, wherein the membrane covers the upper end to seal the channel of the conical protrusion.

10. The cap container as claimed in claim 6, wherein the membrane further has an extrusion connecting to the membrane and protruding from the upper rim of the tank.

11. The cap container as claimed in claim 6, wherein the membrane is made of aluminum foil or plastic, wherein the plastic is polyethylene or polypropylene.

* * * * *